US010370812B1

(12) United States Patent
Thompson

(10) Patent No.: US 10,370,812 B1
(45) Date of Patent: Aug. 6, 2019

(54) ENCAPSULATED UTILITY FLOAT

(71) Applicant: Justin Thompson, Leawood, KS (US)

(72) Inventor: Justin Thompson, Leawood, KS (US)

( * ) Notice: Subject to any disclaimer, the term of this patent is extended or adjusted under 35 U.S.C. 154(b) by 3 days.

(21) Appl. No.: 15/804,806

(22) Filed: Nov. 6, 2017

Related U.S. Application Data

(60) Provisional application No. 62/417,392, filed on Nov. 4, 2016.

(51) Int. Cl.
*E02B 3/06* (2006.01)
*B63B 35/38* (2006.01)

(52) U.S. Cl.
CPC ..... *E02B 3/064* (2013.01); *B63B 35/38* (2013.01)

(58) Field of Classification Search
CPC ..... E01D 15/14; E01D 15/145; E01D 15/20; E01D 15/24; B63B 35/38; B63B 2035/4426; E02B 3/064
See application file for complete search history.

(56) References Cited

U.S. PATENT DOCUMENTS

| | | | | |
|---|---|---|---|---|
| 4,655,156 A * | 4/1987 | Svirklys | B63B 35/38 | 114/266 |
| 5,950,558 A * | 9/1999 | Strong | B63B 35/38 | 114/263 |
| 2012/0103243 A1* | 5/2012 | Gerst | B63B 35/38 | 114/263 |
| 2014/0182504 A1* | 7/2014 | Falcone | E02B 3/064 | 114/263 |

* cited by examiner

*Primary Examiner* — Andrew Polay
(74) *Attorney, Agent, or Firm* — Gable Gotwals

(57) ABSTRACT

Embodiments of a modular flotation section include a utility trough molded into an upper end of the modular flotation section that extends an entire end-to-end distance of the modular flotation section. The utility trough has an open top end level with a top surface of the modular flotation section, opposing sidewalls that extend downward from the top surface, a closed bottom end, and two opposing open side ends. A depth and width of the utility trough is less than, respectively, a total height and width of the modular flotation section. Electrical cables, water lines, or a combination of the two may be placed within the trough, thereby isolation the cables and lines from the dock frame.

14 Claims, 14 Drawing Sheets

ENCAPSULATED UTILITY FLOAT

CROSS REFERENCE TO RELATED APPLICATIONS

This application claims priority to U.S. Prov. Pat. Appl. Ser. No. 62/417,392, filed Nov. 4, 2016, the contents of which are incorporated by reference.

BACKGROUND

This disclosure relates to boat docks and, more particularly, to structures that accommodate marina construction utilities.

In marina construction, encapsulated flotation is only used to float the dock, not to support the utilities of the dock. The utilities are typically run through the structure or frame of the dock. When the dock is damaged and a metal frame or wooden structural member needs to be replaced, all electrical utilities have to be pulled from the nearest termination. The frame is then replaced and the electrical and water utilities are reinstalled.

In scenarios where a "box" frame is used, electrical utilities when designed with single insulated wired are installed within PVC conduit which is ran through interior voids of the frame. When docks are installed with jacketed electrical cable, the cable is clamped to the frame of the dock to prevent wear on the cable, and laid on top of the flotation when metal is not present. Water and wastewater utilities are always installed through PVC and run through the frame of the dock.

In situations where the dock is made of a wooden structure, the wood is cut with holes that match the size of the utility cable and PVC size required. This creates a weaker dock and adds time to the installation. The cables are placed on top of the floatation when a wooden structure is not present.

Often times the electrical cable rubs on the metal or wood frame of the dock, eventually leading to an exposed electrical cable. This not only creates shorts in the wire that lead to potential fire hazard, it exposes people to electrical shock and potential death when the electrical current disperses through the water. Furthermore, damage to the electrical cable occurs when the dock is damaged as a result of storms. For example, a frame can cut the electrical cable when the frame is warped, sheared, and mis shaped because of the storm.

SUMMARY

Embodiments of a modular float design allows marina utilities to run under the main frame of the dock while at the same time adding strength and durability to the float. Utility trays or troughs are molded directly into the float where previously the float had been flat along its upper surface. These troughs simplify and separate the installation of all electric, potable water, and non-potable water. At the same time the troughs allow the dock to be modified without disrupting the marina. Because the utilities would avoid the interior voids of the frame, safety is increased, installation time is decreased, and maintenance costs are lowered.

By installing the utilities below the main (galvanized metal) frame, there is less risk of the frame causing damage to an electrical cable. The cable's insulation no longer contacts or rubs against the structure of the dock, nor is it exposed to the frame during storms. Additionally, the dock no longer needs to be drilled with holes to install any utilities. With the absence of these holes there is added strength to the dock. Last, maintaining the dock becomes a much easier process.

ELEMENTS USED IN THE DRAWINGS AND DETAILED DESCRIPTION

Figure 1:
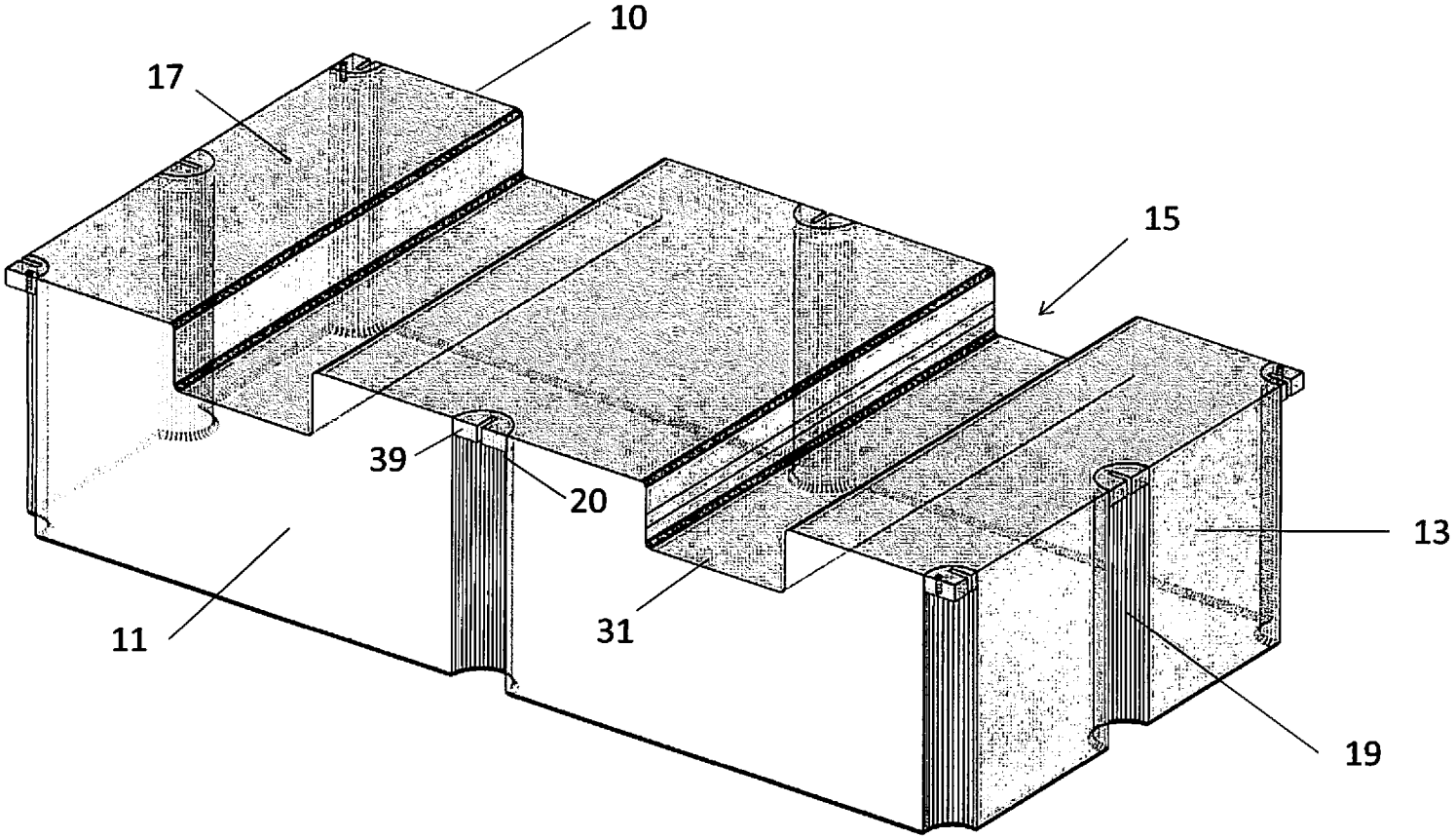
FIG. 1 is an isometric view of an embodiment of a modular float design that includes two utility trays or troughs molded into a top side of the float. The utility troughs run side-to-side.

10 Modular float or flotation section of a dock
11 Long (front or rear) side
13 Short (left or right) side
14 Periphery
15 Utility tray or tough
17 Top end or surface
19 Dock socket or connector
20 Uppermost end
21 Depth of 15
23 Width of 15
25 Open upper end
27 Closed bottom end or floor
29 Sidewall
31 Open side end
33 Hangar
39 Flange
41 Open-ended slot
M Main frame

DETAILED DESCRIPTION OF PREFERRED EMBODIMENTS

Figure 2:
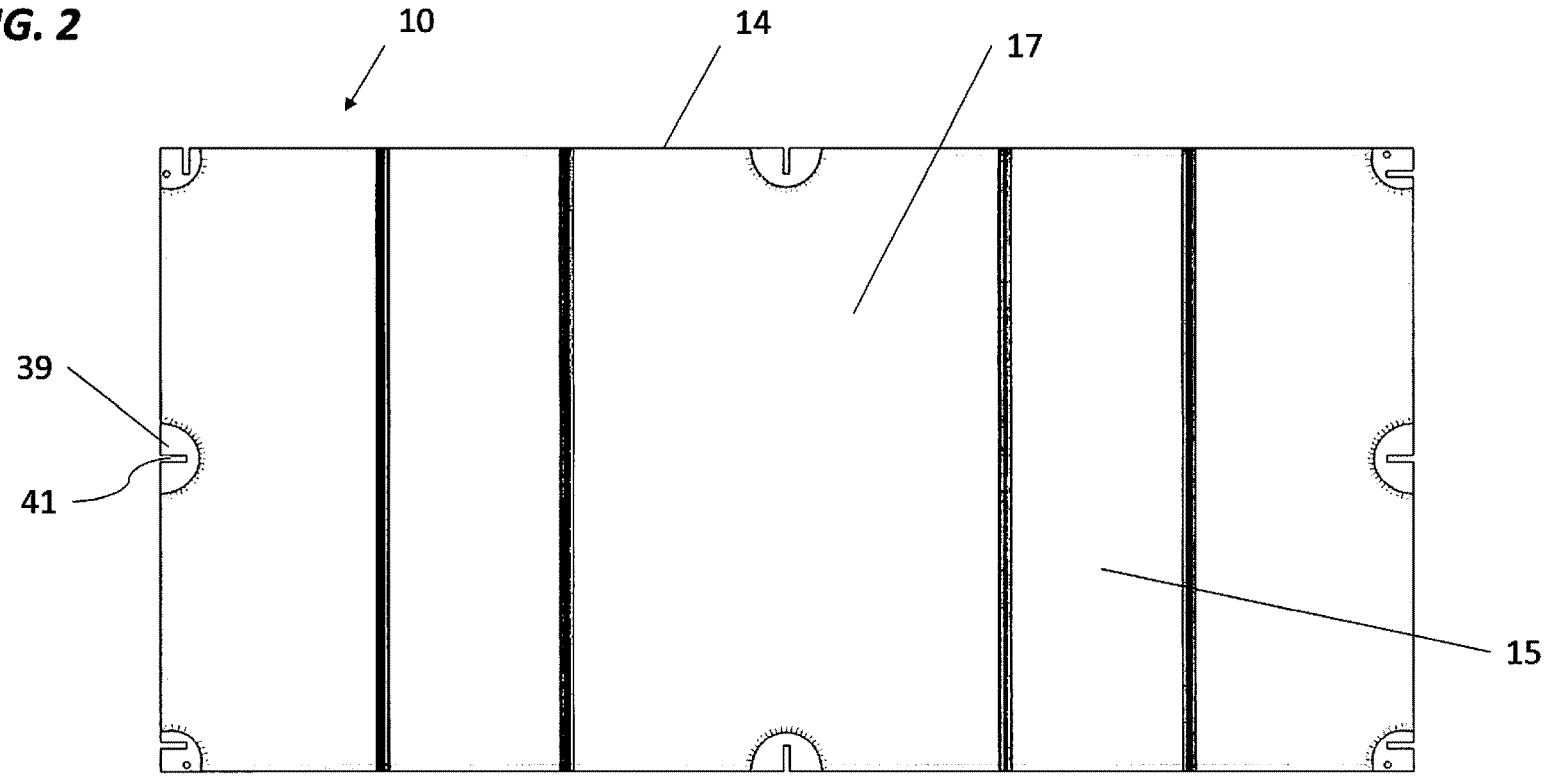
FIG. 2 is a top view of an embodiment of a modular float design of FIG. 1.
Figure 3:
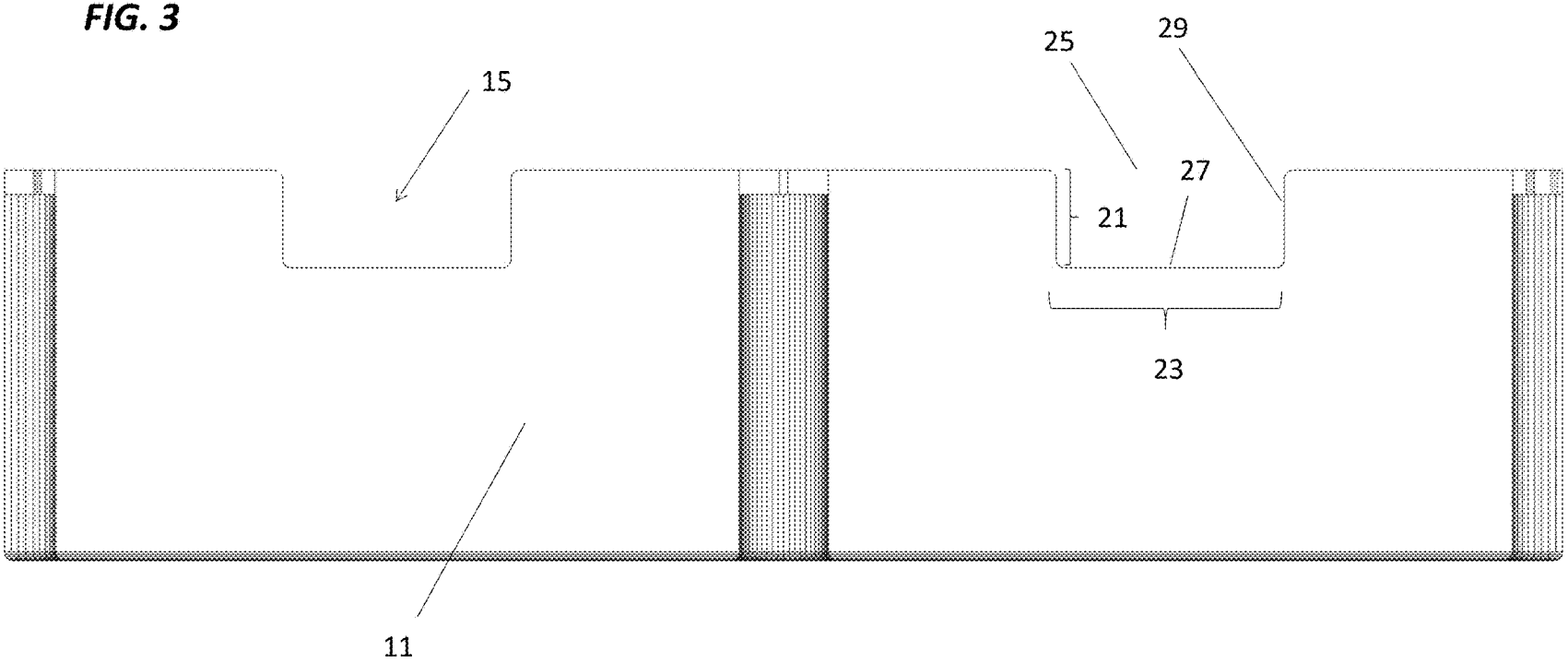
FIG. 3 is a side elevation view of the float of FIG. 1, the left- and right-hand sides being mirror images.
Figure 4:
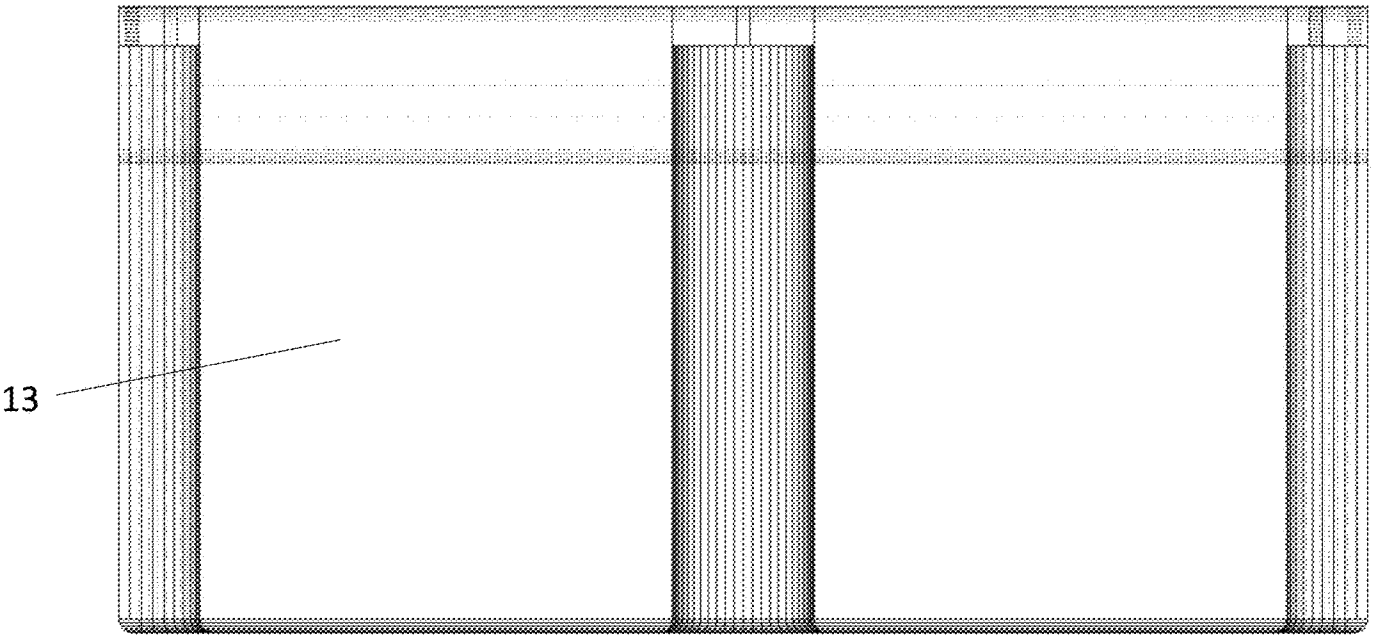
FIG. 4 is a front elevation view of the float of FIG. 1, the front and rear sides being mirror images.
Figure 5:
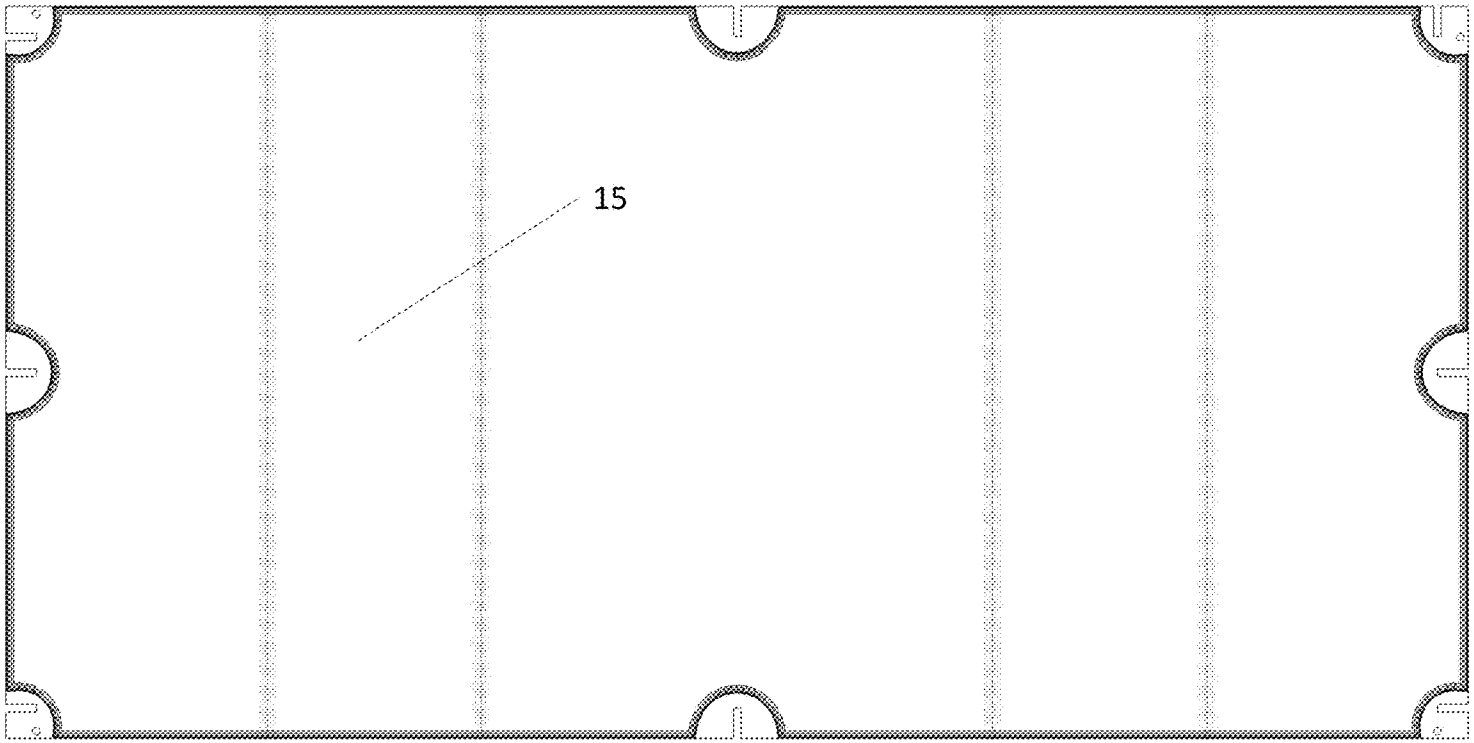
FIG. 5 is a bottom view of the float of FIG. 1.
Figure 6:
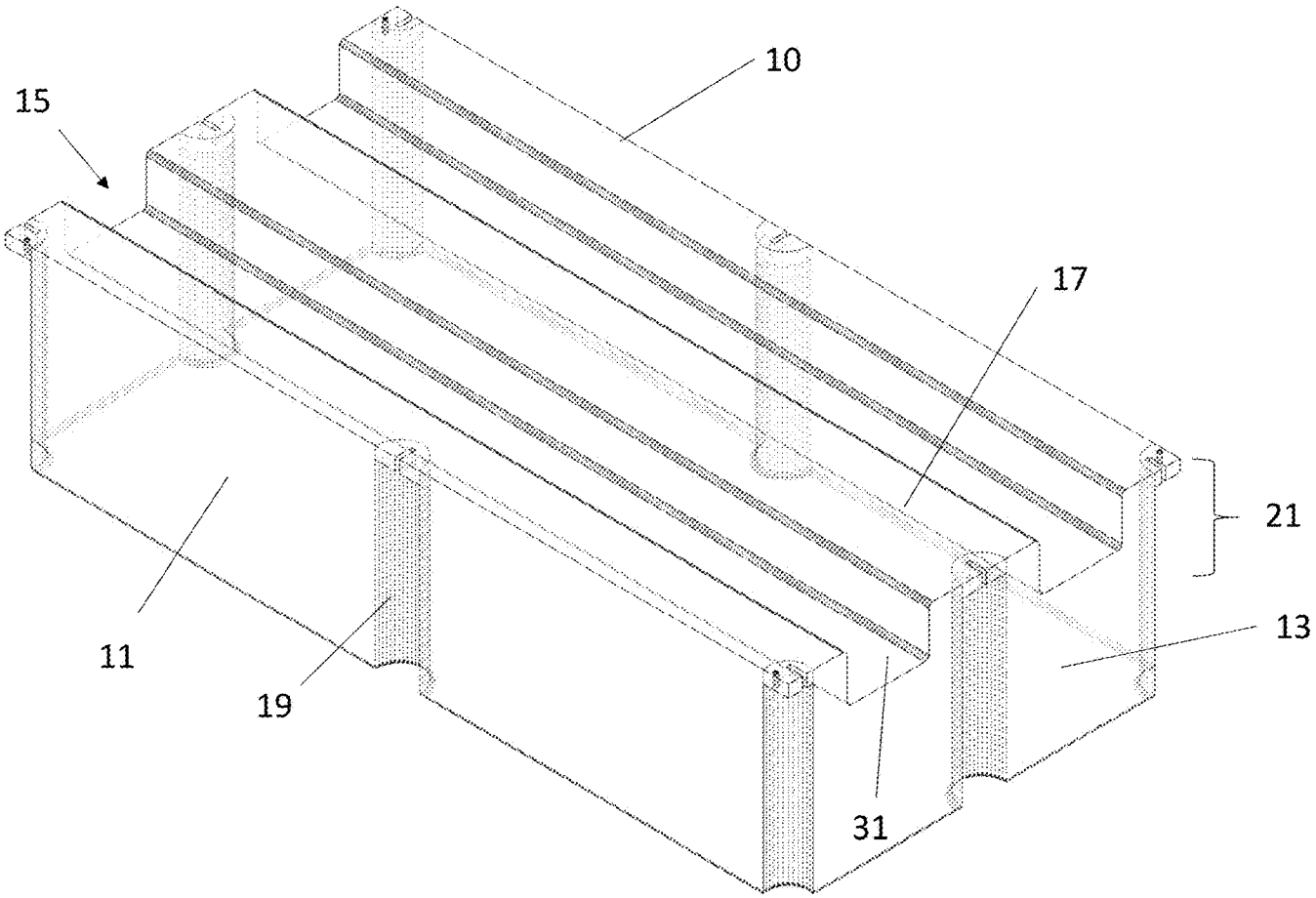
FIG. 6 is an isometric view of another embodiment. The utility troughs run front-to-back.
Figure 7:
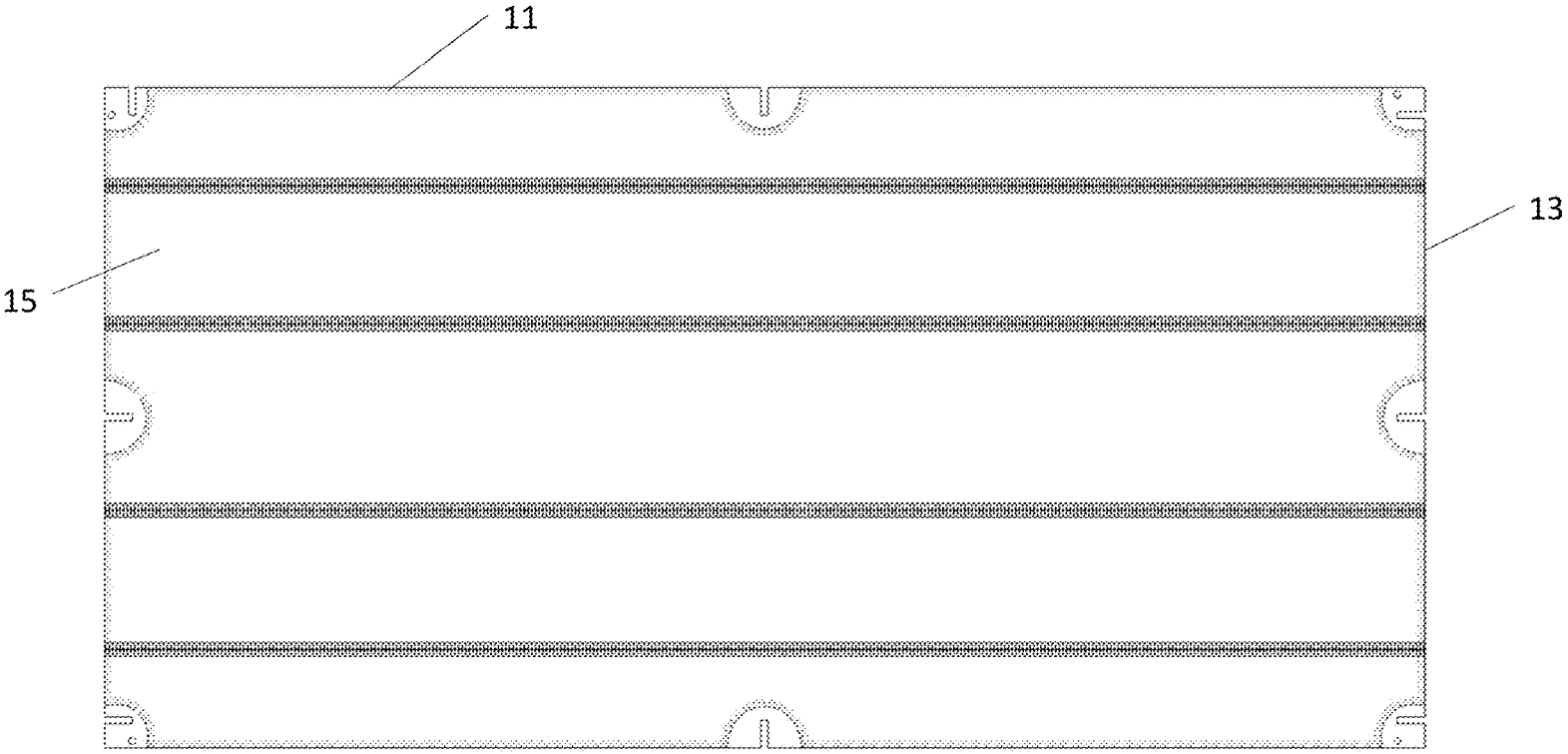
FIG. 7 is a top view of the float of FIG. 6.
Figure 8:
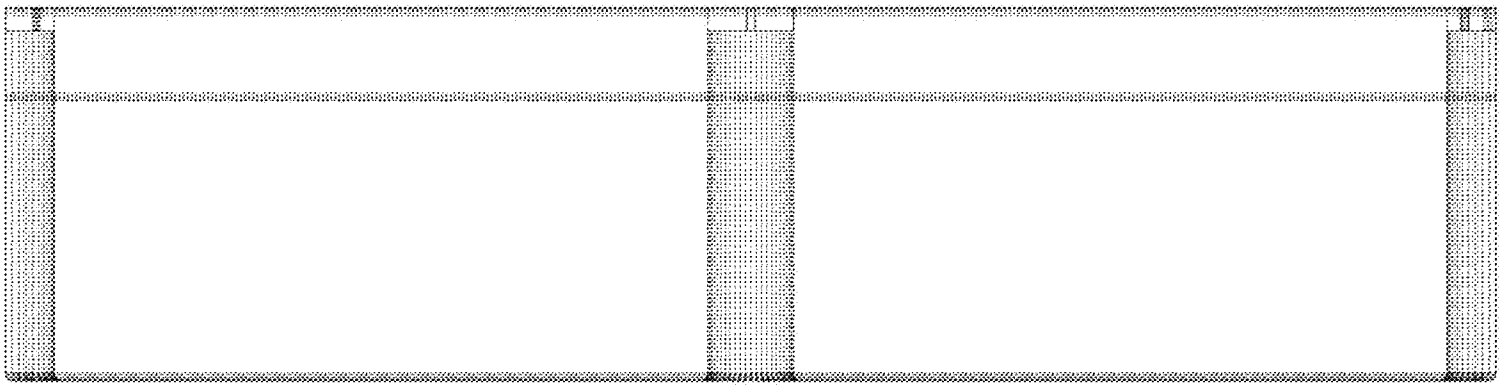
FIG. 8 is a side elevation view of the float of FIG. 6.
Figure 9:
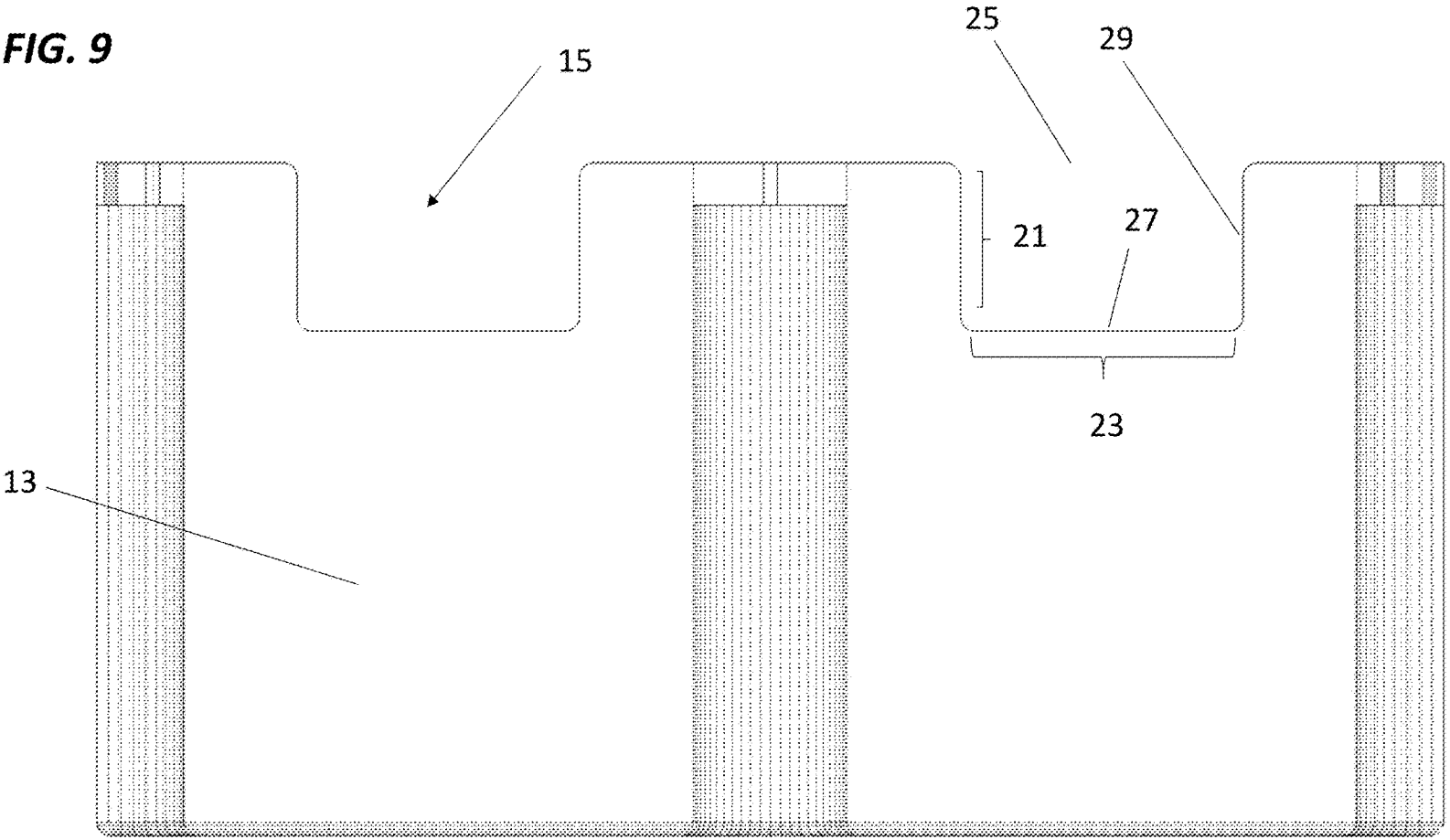
FIG. 9 is a front elevation view of the float of FIG. 6.
Figure 10:
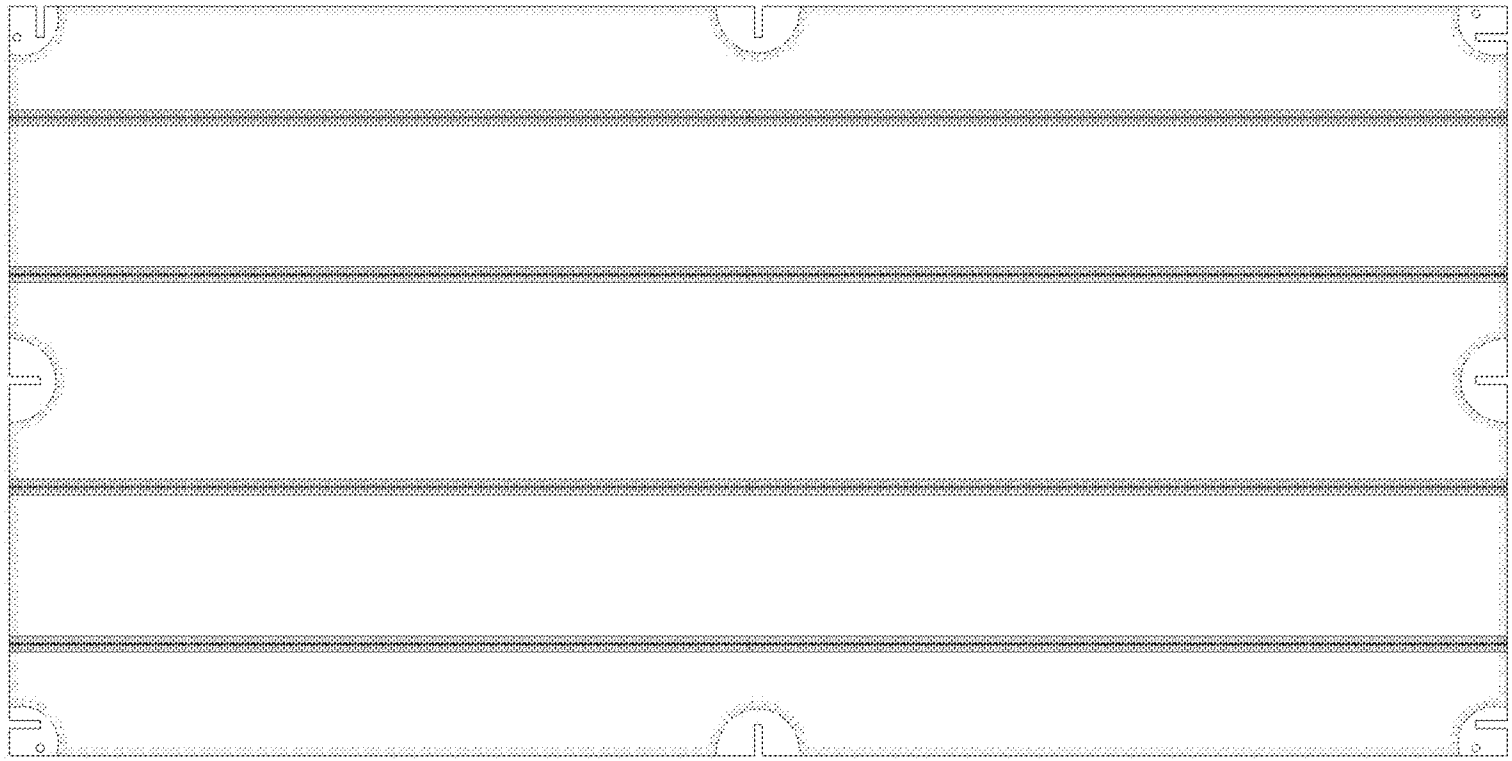
FIG. 10 is a bottom view of the float of FIG. 6.
Figure 11:
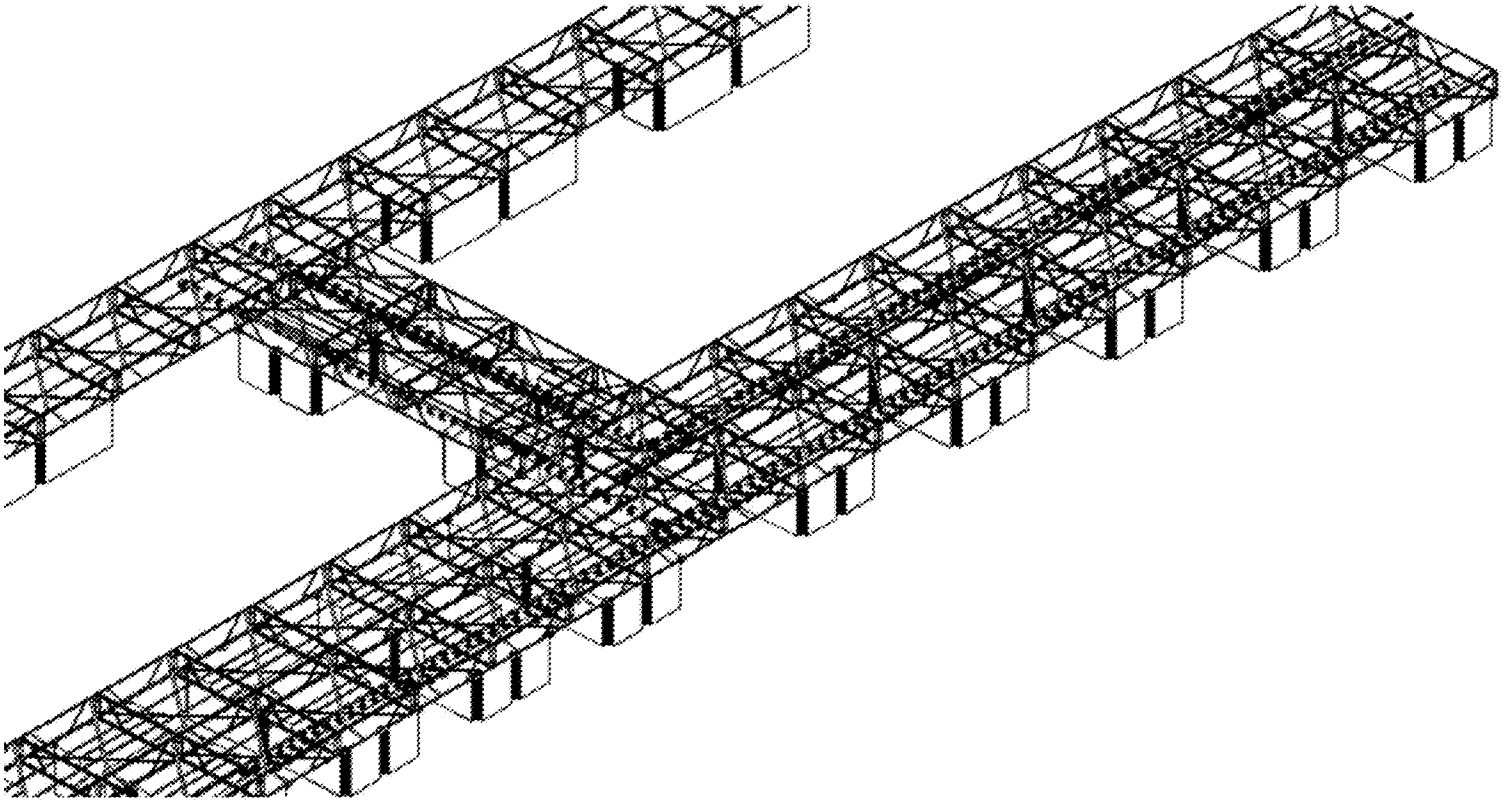
FIG. 11 is an isometric view of an embodiment when connected to a dock frame, providing encapsulated flotation to float the dock and support the utilities of the dock.
Figure 12:
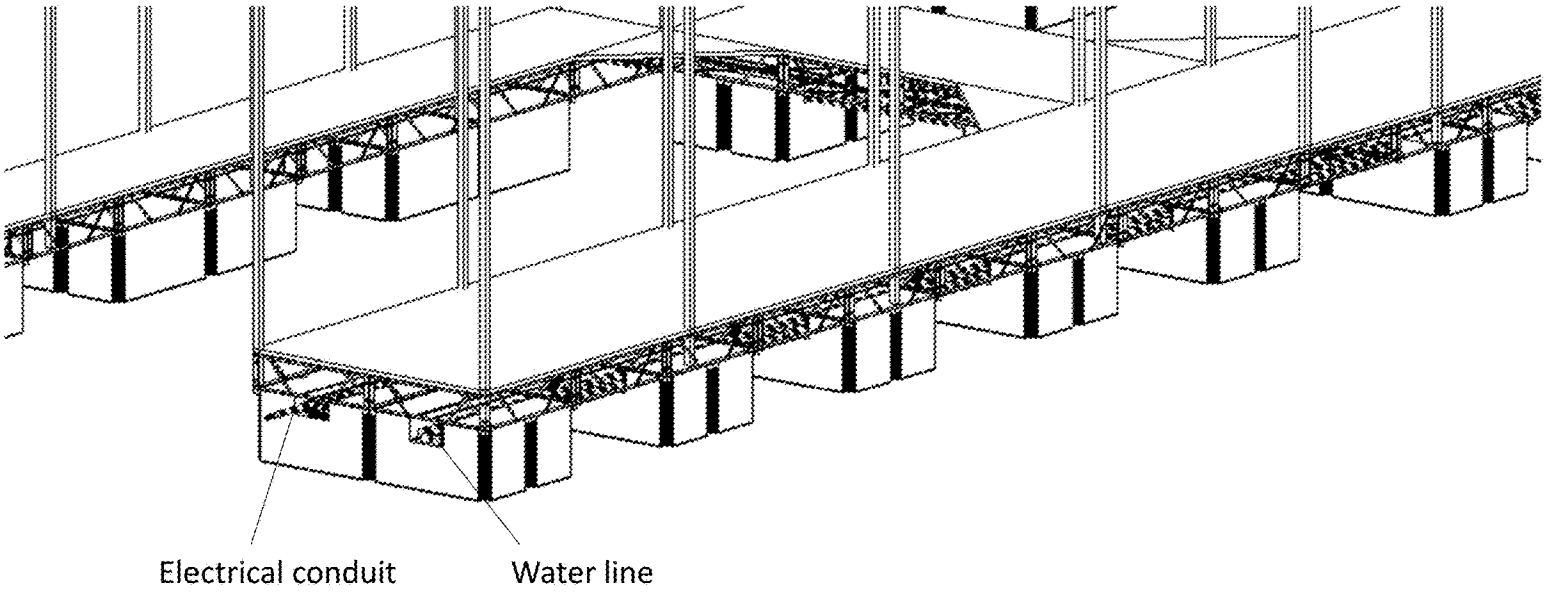
FIG. 12 is an isometric view of the dock of FIG. 11 with decking connected to the dock frame.
Figure 13:
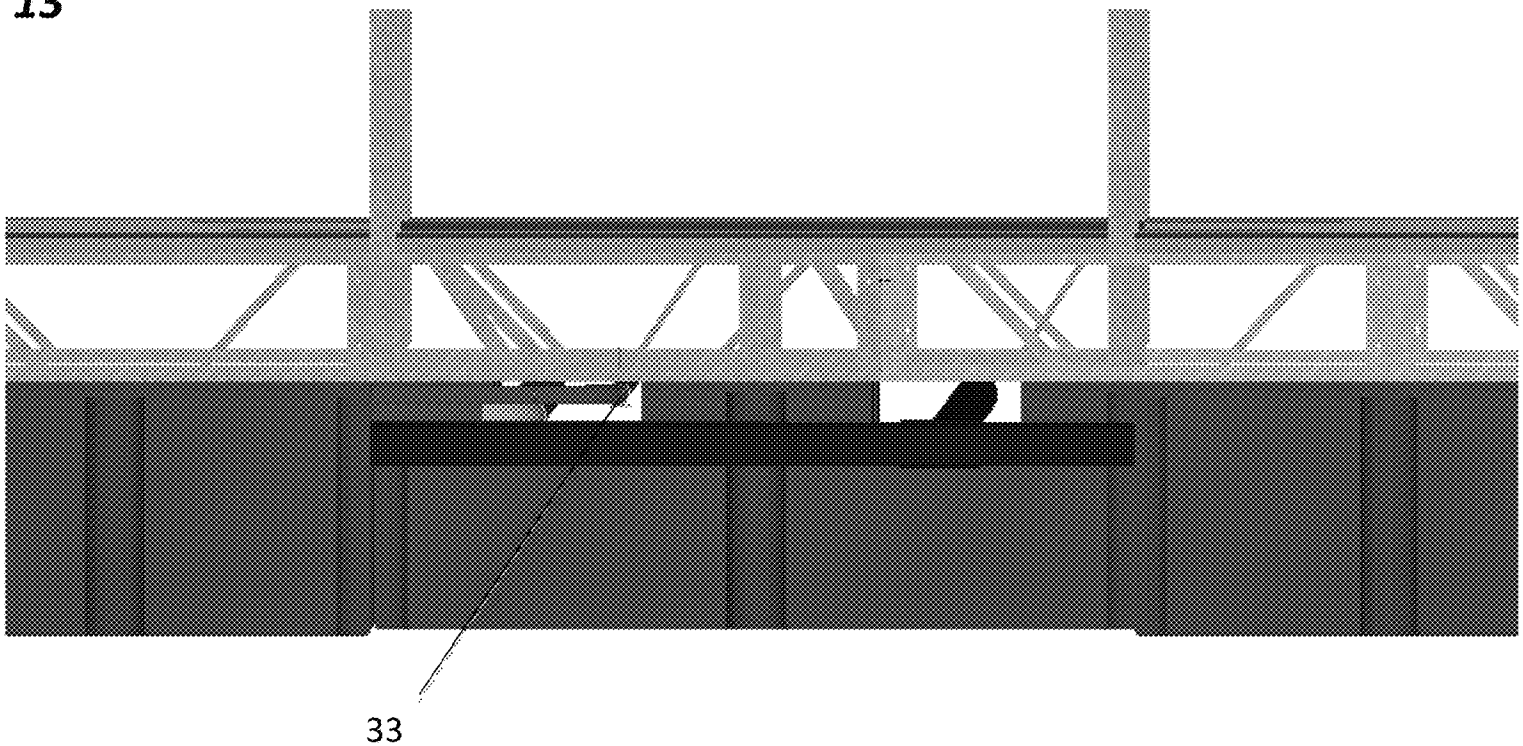
FIG. 13 is an embodiment in which hangars are used.
Figure 14:
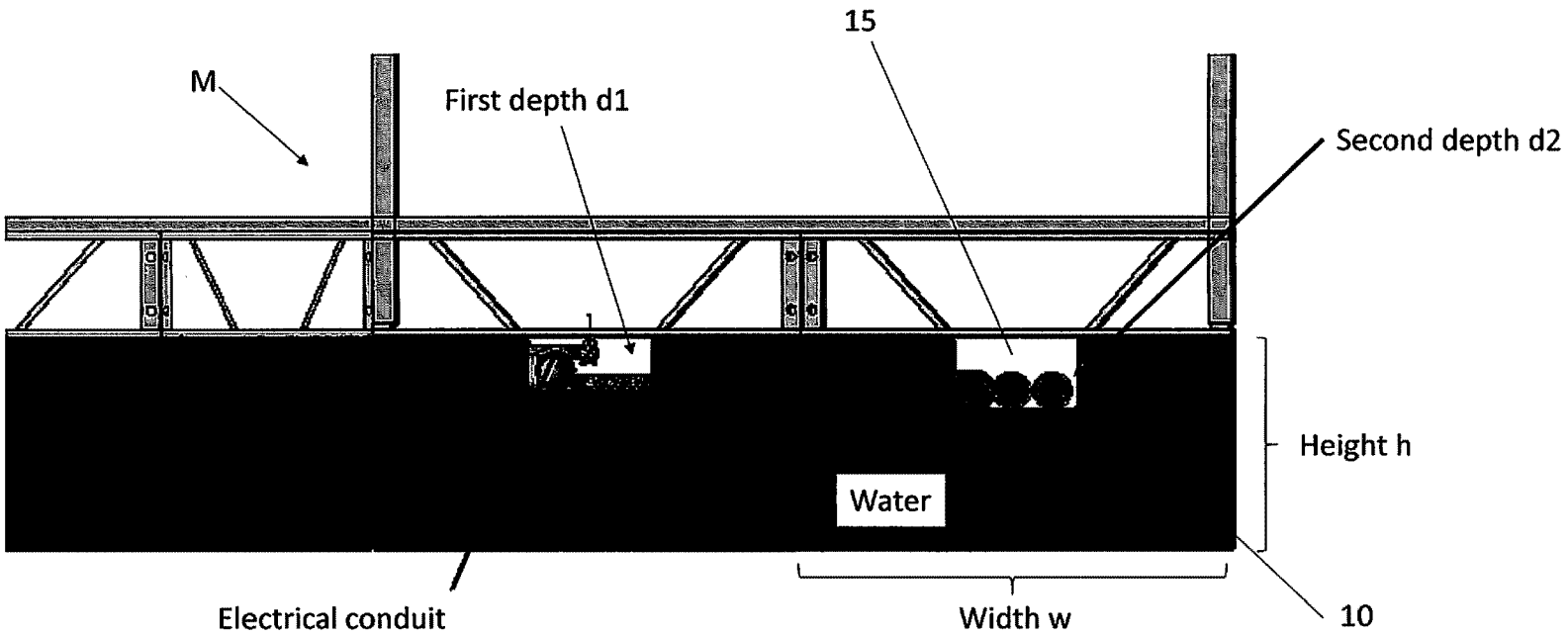
FIG. 14 is an embodiment in which the utility trough height or depth of one flotation section differs from that of another flotation section.

Referring to the drawings, an encapsulated modular float or flotation section 10 arranged for connection to a main frame M of a dock—and to other sections 10 by way of sockets or connectors 19—includes one or more spaced apart utility trays or troughs 15 that are molded into a top end 17 of the section 10 and extend an entire width (FIGS. 1-5) or length (FIGS. 6-10) of the section 10. The section 10 may be made of any material known in the art that is suitable for use as a flotation section.

In embodiments, a plurality of spaced apart sockets 19 are located along a periphery 14 of the modular flotation section 10, each socket 19 of the plurality oriented perpendicular to the top surface 17 of the modular flotation section 10, an uppermost end 20 of each socket 19 extending to the top surface 17 of the modular flotation section 10. Located at the uppermost end 20 of a respective socket 19 is a flange 39 oriented parallel to the top surface 17 of the modular flotation section 10, each flange 39 including an open-ended slot 41 open toward the periphery 14 of the modular flotation section 10 and sized to receive a fastener for attachment to a portion of the main frame M. The flange 39 is shaped complementary to the socket 19. The sockets 19 and flanges 39 may be semi-circular shaped.

The troughs 15 are generally U-shaped in cross-section (but can be any shape preferable) with an open upper end 25, a closed bottom end or floor 27, and sidewalls 29 forming a right angle with the floor 27. In embodiments, electric conduit or cables can be run along one of the troughs 15 and potable and non-potable water pipes or lines can be run along the other trough 15. The cables or lines rest on the closed bottom end or floor 27 of the trough 15, between sidewalls 29. In other embodiments, the cables or lines are suspended from the frame by hangars 31. The open ends 31 of the trough 15 permit the cables or lines to run from one flotation section 10 to the next flotation section 10.

The depth 21 and width 23 of the trough 15 are sized appropriate for the application, with the depth 21 being less than an overall height "h" of the modular flotation section 10 and the width 23 being less than an overall width "w" of the section 10. The depth 21 may vary from section 10 to section 10 (as may the width 23 or both width and depth). In some embodiments, trough 15 has a depth "d1" and another trough 15 a different depth "d2." The depth 21 is such that none of the cables or utility lines when laid in the trough 15 contact the main frame of the dock. The troughs 15 do not significantly affect the flotation performance of the section 10.

While embodiments of an encapsulated utility float have been described in detail, modifications may be made in the details of construction or method of use without departing from the scope of this disclosure or the following claims. The claims encompass the full range of equivalents to which each recited element or step is entitled.

The invention claimed is:

1. A modular flotation section configured for connection to a main frame of a dock structure, the modular flotation section comprising;

a pair of spaced apart utility troughs at an upper end of the modular flotation section and extending an entire end-to-end distance of the modular flotation section, a plurality of spaced apart sockets located along a periphery of the modular flotation section, each socket of the plurality oriented perpendicular to the top surface of the modular flotation section, an uppermost end of each socket extending to the top surface of the modular flotation section;

a plurality of flanges, each flange of the plurality shaped complementary to and located at the uppermost end of a respective socket of the plurality of sockets and oriented parallel to the top surface of the modular flotation section, each flange including an open-ended slot open toward the periphery of the modular flotation section sized to receive a fastener for attachment to a portion of the main frame;

each utility trough of the pair including:

an open top end level with the top surface of the modular flotation section, opposing sidewalls extending downward from the top surface of the modular flotation section, a closed bottom end, and two opposing open side ends;

a depth of the utility trough being less than a total height of the modular flotation section.

2. A modular flotation section according to claim 1 wherein a width of the at least one utility trough is less than a total width of the modular flotation section.

3. A modular flotation section according to claim 1, further comprising each socket of the plurality of sockets being semi-circular shaped.

4. A modular flotation section according to claim 1, further comprising each socket of the plurality of sockets extending an entire height of the modular flotation section.

5. A modular flotation section according to claim 1, the opposing sidewalls each being at a right angle to the closed bottom end.

6. A modular flotation section according to claim 1, further comprising each flange of the plurality of flanges being semi-circular shaped.

7. A method of providing dock flotation and supporting dock utilities, the method comprising:

connecting a dock frame to one or more modular flotation sections, each of the one or more modular flotation sections including at least one utility trough; and after the connecting, floating the dock frame using the one or more modular flotation sections;

wherein each of the modular sections further include:

a plurality of spaced apart sockets located along a periphery of the modular flotation section, each socket of the plurality oriented perpendicular to top surface of the modular flotation section, an uppermost end of each socket extending to the top surface of the modular flotation section;

a plurality of flanges, each flange of the plurality shaped complementary to and located at the uppermost end of a respective socket of the plurality of sockets and oriented perpendicular to the respective socket, each flange including an open-ended slot open toward the periphery of the modular flotation section and sized to receive a fastener for attachment to a portion of the main frame;

wherein the at least one utility trough is located at an upper end of the modular flotation section and extends an entire distance of the modular flotation section;

wherein a depth of the at least one utility trough is less than a height of the modular flotation section, and wherein a width of the at least one utility trough is less than a width of the modular flotation section.

8. A method according to claim 7 further comprising placing one or more utility lines within the at least one utility trough.

9. A method according to claim 8, wherein the one or more utility lines includes at least one electrical cable.

10. A method according to claim 8, wherein the one or more utility lines includes at least one water line.

11. A modular flotation section according to claim 1, further comprising:

a metal dock frame, the portion of the main frame being the metal dock frame.

12. A modular flotation section according to claim 1, further comprising:

a wood dock frame, the portion of the main frame being the wood dock frame.

13. A modular flotation section according to claim 1, further comprising a second utility trough spaced apart from and arranged parallel to the at least one utility trough.

14. A modular flotation section according to claim 13, further comprising at least one socket of the plurality of sockets located between the at least one and second utility troughs.

* * * * *